US011859485B1

(12) United States Patent
Samuel

(10) Patent No.: US 11,859,485 B1
(45) Date of Patent: Jan. 2, 2024

(54) TRIP MAP FOR ADJUSTING A TRIPPING OPERATION IN A WELLBORE

(71) Applicant: Landmark Graphics Corporation, Houston, TX (US)

(72) Inventor: Robello Samuel, Cypress, TX (US)

(73) Assignee: Landmark Graphics Corporation, Houston, TX (US)

( * ) Notice: Subject to any disclaimer, the term of this patent is extended or adjusted under 35 U.S.C. 154(b) by 0 days.

(21) Appl. No.: 17/820,181

(22) Filed: Aug. 16, 2022

(51) Int. Cl.
*E21B 44/00* (2006.01)

(52) U.S. Cl.
CPC ..... *E21B 44/00* (2013.01); *E21B 2200/20* (2020.05); *E21B 2200/22* (2020.05)

(58) Field of Classification Search
CPC ... E21B 44/00; E21B 2200/20; E21B 2200/22
See application file for complete search history.

(56) References Cited

U.S. PATENT DOCUMENTS 9,441,427 B2 9/2016 Pilgrim
2012/0317478 A1* 12/2012 Hantschel ..... G01V 99/00 715/255
2015/0142318 A1 5/2015 Hildebrand et al.
2016/0053605 A1 2/2016 Abbassian et al.
2020/0355059 A1 11/2020 Zhang et al.
2021/0389855 A1 12/2021 Rolong et al.
2022/0251927 A1 8/2022 Samuel et al.
2022/0372871 A1* 11/2022 Millward ..... E21B 21/08

OTHER PUBLICATIONS

International Search Report and Written Opinion, PCT/US2022/075039, dated May 9, 2023, 9 pages.

* cited by examiner

*Primary Examiner* — Dany E Akakpo
(74) *Attorney, Agent, or Firm* — Kilpatrick Townsend & Stockton LLP

(57) ABSTRACT

A system can generate a trip map for adjusting a tripping operation in a wellbore. The system can receive input data from a downhole tool in a wellbore. The system can determine parameters for the tripping operation. The system can determine an overall condition for an interval of the wellbore based on the parameters. The system can determine a status for the parameters and for the overall condition based on a difference between the parameters or the overall condition and a corresponding optimized value. The system can generate a trip map using the parameters and the overall condition. The trip map can include a background shape and a polygon that can be positioned on the background shape. The polygon can include corners corresponding to the parameters and overall condition that are positioned angularly around the background. The trip map can be output to adjust the tripping operation.

20 Claims, 7 Drawing Sheets

TRIP MAP FOR ADJUSTING A TRIPPING OPERATION IN A WELLBORE

TECHNICAL FIELD

The present disclosure relates generally to wellbore operations and, more particularly (although not necessarily exclusively), to a trip map for adjusting a tripping operation in a wellbore.

BACKGROUND

A wellbore can be formed in a subterranean formation for producing or extracting fluid from the subterranean formation. The fluid can include hydrocarbon fluid such as oil and gas, etc. Various operations can be performed with respect to the wellbore. The various operations can include a tripping operation that can involve, for example, removing pipe or replacing pipe in the wellbore. Tripping operations may be performed when part of the drill string, such as the bit, is to be replaced, or in other suitable circumstances. During tripping operations, the wellbore can be subject to various pressures. For example, pressure can increase in the wellbore due to downward movement of the pipe or pressure can decrease in the wellbore due to upward movement of the pipe. Tripping operations can be difficult to control.

DETAILED DESCRIPTION

Figure 1:
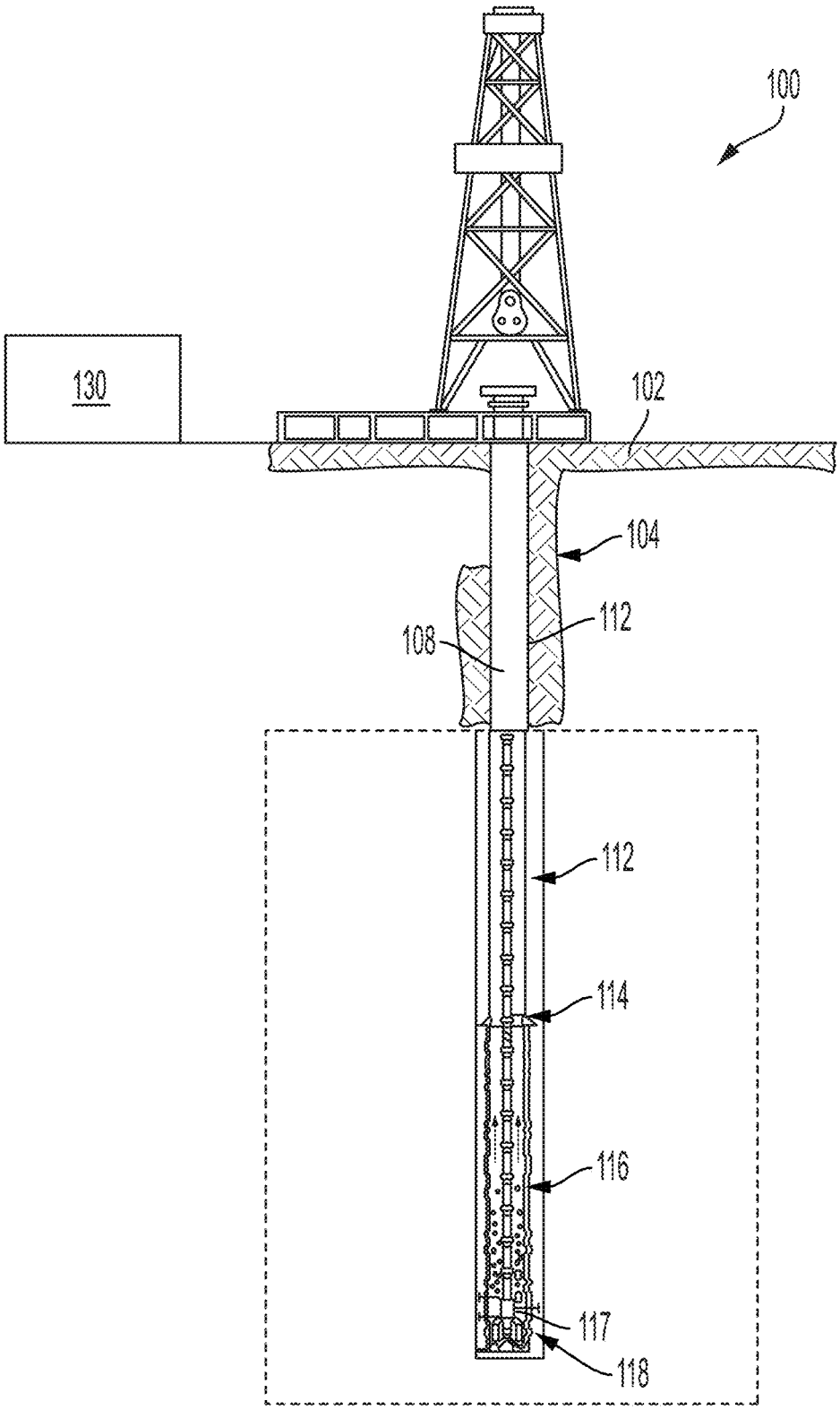
FIG. 1 is a schematic of a well system that can facilitate a tripping operation according to one example of the present disclosure.

Certain aspects and examples of the present disclosure relate to a trip map for adjusting a tripping operation with respect to a wellbore. The tripping operation can be performed to, for example, replace a worn-down drill bit at a downhole end of the drill string. The trip map can be generated for an interval of the wellbore during the tripping operation. The trip map can be a visual representation of the parameters, the overall condition, and the status of the wellbore during the tripping operation, and can be provided on a user interface and otherwise used to adjust the tripping operation. In some examples, tripping operation set points for the interval of the wellbore can be determined based on the trip map. Moreover, the trip map for the interval of the wellbore can indicate that the wellbore is unstable, for example, due to excess pressure from the force of replacing a drill string. The tripping operation can be adjusted based on the trip map to reduce pressure and improve the stability of the wellbore.

Examples of parameters can include swab influx, swab pressure, runnability index, equivalent circulating density, equivalent mud weight, optimum speed, static drag, and pore pressure. The overall condition can be a measurement of the condition of the tripping operation with respect to the wellbore. The overall condition can be determined by combining parameter values to generate an overall condition value. The status of the tripping operation can be an indication of the stability of the wellbore during the tripping operation. The status can be determined by comparing the parameter values to measured values from theoretical data or by comparing the overall condition value to a measured overall condition value.

The stability, conditions, or additional features of the wellbore can change significantly over a length of the wellbore during the tripping operation, which can make it difficult to determine the parameters and the overall condition of the tripping operation with respect to the wellbore. Additionally, the current techniques that can provide tripping operation set points, operational parameters, or control parameters for the tripping operation are inefficient and time consuming. Thus, a strategy is needed for determining tripping operation set points, operational parameters, control parameters, or a combination thereof faster to maintain optimal conditions or stability in the wellbore during the tripping operation. The trip map can provide the parameters and the overall condition of the tripping operation in an intuitive and efficient manner. The trip map can be used to improve the efficiency of the tripping operation by enabling quick decisions regarding operational parameters, control parameters, tripping operation set points, or a combination thereof. The increase in efficiency of the tripping operation due to the trip map can be analyzed with ultimate cost and outcome functions.

The trip map can provide parameter conditions and overall conditions of the tripping operation by bracketing various parameters under a corresponding unit condition. The parameter conditions, overall conditions, or a combination thereof can be used to determine tripping operation set points during the tripping operation in the wellbore. For example, in an autonomous drilling system, the tripping operation setpoints, operational parameters, and control parameters for the tripping operation can be determined using a decision-making control loop that includes the trip map. The decision-making control loop that includes the trip map can provide effective solutions for the autonomous drilling system or any other well system. In additional examples, the efficiency of the tripping operation can be estimated based off a comparison of a set of current operational parameters for the tripping operation and the operational parameters determined using the trip map. The trip map can also facilitate better forward prediction of the operational efficiency of future tripping operations. The trip map can further enable analysis of the stability of the wellbore. For example, the trip map can provide a region in which the wellbore is subject to excess pressure from tripping operation.

The trip map can be displayed as a two-dimensional trip map or a three-dimensional trip map. The trip map can include various control parameters such as runnability, trip speed, equivalent circulating density, kick, loss indicators, etc. The various control parameters can be mapped on the trip map, compared against theoretical models, and made on a unit line on the trip map. Additional parameters can include pick up or slack off drag values. The overall condition can be a combination of the various control parameters or additional parameters. The depth of the wellbore versus the overall condition of the tripping operation and individual control parameters, operational parameters, or other suitable parameters can be monitored throughout the tripping operation to analyze trends of the tripping operation with respect to the wellbore.

The trip map can include additional limits that can be calculated for a sub-interval of the wellbore during the tripping operation. Optimal limit values can also be calculated during the tripping operation based on wellbore pressure or additional wellbore conditions. The sub-interval can be selected to be small enough that the calculations in the sub-interval can be assumed to be constant over the sub-interval. For example, the sub-interval selected can be 1 foot. For the sub-interval, it can be assumed that the wellbore pressure changes continuously during the tripping operation and that the amount of change depends on uncontrolled or uncertain parameters. Uncontrolled or uncertain parameters can include formation, anisotropy, dip, etc. Additionally, the limits may be calculated continuously during the tripping operation due to changes in the formation and depth of the wellbore, the friction factor, rock strength, the length of drill pipe, or additional parameter changes. A drilling interval may also be established or adjusted based on the limits calculated. The limits calculated can include torsional instability, lateral instability, rate of penetration (ROP) coupled bit wear, hole cleaning, mechanical specific energy, motor stall weight, motor stall speed, or other suitable limits. An optimized, stable region of the wellbore can be calculated bounded with the limits. The optimization of regions of the wellbore using the limits can be used to obtain operational parameters to improve the efficiency of the tripping operation or to place a well efficiently.

Illustrative examples are given to introduce the reader to the general subject matter discussed herein and are not intended to limit the scope of the disclosed concepts. The following sections describe various additional features and examples with reference to the drawings in which like numerals indicate like elements, and directional descriptions are used to describe the illustrative aspects, but, like the illustrative aspects, should not be used to limit the present disclosure.

FIG. 1 is a schematic of a well system 100 that can facilitate a tripping operation according to one example of the present disclosure. As illustrated, the well system 100 includes a wellbore 108 formed in a subterranean formation 104. The subterranean formation 104 can include sandstone, limestone, or additional rock formations. As illustrated, the wellbore 108 is at least partially drilled and completed. The wellbore 108 can include a casing string 112 that can be cemented within the wellbore 108 and can provide a conduit for produced formation fluids, such as oil or gas, to travel from downhole in the wellbore 108 to the well surface 102. Additionally, the wellbore 108 can include a drill string 114 that can include drill pipe, heavy weight drill pipe, drill collars and additional components such as stabilizers and drilling jars. The drill string 114 can be used to suspend a drill bit 118, which can drill through various layers of the subterranean formation 104. The drill string 114 can further transmit a rotary motion to the drill bit 118 or provide a flow path to circulate drilling fluids.

In some examples, the well system 100 can facilitate a tripping operation. During the tripping operation, the drill string 114 can be removed or replaced in an open hole portion 116 (or other suitable portion) of the wellbore 108. Removing the drill string 114 can be referred to as tripping out and replacing the drill string 114 can be referred to as tripping in. A tripping-out operation can include pulling a first portion of the drill string 114 out of the wellbore 108, disconnecting the first portion of the drill string 114, removing the first portion of the drill string 114 via a derrick, and storing the first portion of the drill string 114 on a pipe storage rack. The tripping out tripping operation can be repeated until a certain amount of the drill string 114 is removed from the wellbore 108. In an example, the drill string 114 can be disconnected at every third joint or every 30 meters (98.42 feet) as the drill string 114 is pulled out of the wellbore 108. A tripping-in operation can include reconnecting the first portion of the drill string 114, guiding the first portion of the drill string 114 downhole in the wellbore 108, and repeating with subsequent portions of the drill string 114 until the certain amount of the drill string 114 is replaced in the wellbore 108. The tripping operation may be performed when a drill bit 118 has become worn-down, to replace downhole tools in the wellbore 108, or to replace damaged drill string 114. The wellbore 108 can endure reduced pressure during the tripping out tripping operation and increased pressure during the tripping-in operation. Other suitable examples of a tripping operation involving the well system 100 are possible.

Parameters relating to the wellbore 108 or relating to the tripping operation can be determined and monitored. The parameters of the tripping operation can be determined based on data collected by a downhole tool 117, such as a measurement-while-drilling (MWD) tool or a logging-while-drilling (LWD) tool, positioned downhole in the wellbore 108. The data collected by the downhole tool 117 can be received by a computing device 130. In an example, the downhole tool 117 collects data for a predetermined interval of the wellbore 108 during the tripping operation. The predetermined interval can be set or adjusted by an operator or autonomously by the computing device 130. The computing device 130 may access one or more micro-services, engineering models, or the like to output the parameters.

Parameters of the tripping operation can include swab influx, swab pressure, runnability index, equivalent circulating density, equivalent mud weight, optimum speed, static drag, pore pressure, or other suitable parameters. Swab influx can be an influx of fluid into the wellbore 108 due to the removal or replacement of the drill string 114. Swab pressure can be a change in pressure in the wellbore 108 due to the removal or replacement of the drill string 114. Runnability index can be a measure of the performance or efficiency of the tripping operation. Equivalent circulating density can be a density exerted on the wellbore 108 by a circulating fluid in the wellbore 108. Equivalent mud weight can be a mud weight needed to balance a pressure imposed on the wellbore 108 by the circulating fluid. The optimum speed can refer to the speed the drill string 114 is moved during an interval or throughout the tripping operation while maintaining the stability of the wellbore 108. Pore pressure can be a pressure of fluids within the pores of the subterranean formation 104.

The computing device 130 can generate a trip map that includes the parameters listed above, additional parameters relating to the wellbore 108, additional parameters relating to the tripping operation, or a combination thereof. The tripping operation can be adjusted or controlled based on the trip map. For example, swab pressure for an interval of the wellbore 108 can be determined based on data collected by the downhole tool 117. The computing device 130 can map the swab pressure on the trip map in an area that correlates to a status of the swab pressure. The status of the swab pressure can be determined by comparing the swab pressure to a measured swab pressure based on theoretical data. In an example, the status of swab pressure can be insufficient, which can indicate that the swab pressure is too high. In response, the speed of the tripping operation can be decreased to improve swab pressure. The tripping operation can also stop, restart, sped up, change direction, or otherwise be altered based on the trip map. The computing device 130 can display the trip map on a user interface for an operator to analyze and adjust the tripping operation or the computing device 130 can provide the trip map as an input for autonomously controlling the tripping operation.

Figure 2:
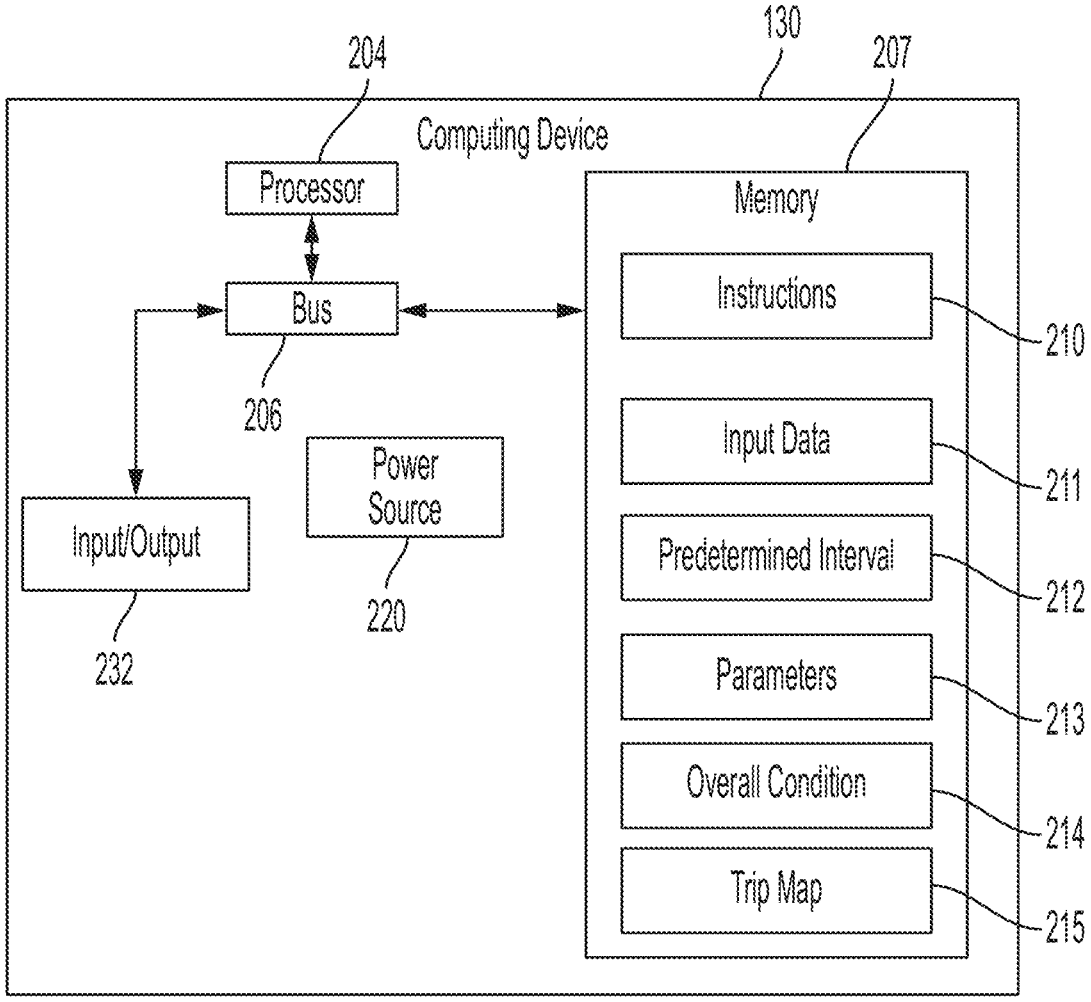
FIG. 2 is a block diagram of a computing device for adjusting a tripping operation in a wellbore using a trip map according to one example of the present disclosure.

FIG. 2 is a block diagram of a computing device 130 for adjusting a tripping operation in a wellbore 108 using a trip map 215 according to one example of the present disclosure. The components shown in FIG. 2, such as a processor 204, a memory 207, a power source 220, an input/output 232, and the like may be integrated into a single structure such as within a single housing of a computing device 130. Alternatively, the components shown in FIG. 2 can be distributed from one another and in electrical communication with each other.

The computing device 130 can include the processor 204, the memory 207, and a bus 206. The processor 204 can execute one or more operations for determining optimal tripping operation parameters using one or more optimization models subject to one or more constraints. The processor 204 can execute instructions 210 stored in the memory 207 to perform the operations. The processor 204 can include one processing device or multiple processing devices or cores. Non-limiting examples of the processor 204 include a Field-Programmable Gate Array ("FPGA"), an application-specific integrated circuit ("ASIC"), a microprocessor, etc.

The processor 204 can be communicatively coupled to the memory 207 via the bus 206. The non-volatile memory 207 may include any type of memory device that retains stored information when powered off. Non-limiting examples of the memory 207 may include EEPROM, flash memory, or any other type of non-volatile memory. In some examples, at least part of the memory 207 can include a medium from which the processor 204 can read instructions 210. A computer-readable medium can include electronic, optical, magnetic, or other storage devices capable of providing the processor 204 with computer-readable instructions or other program code. Nonlimiting examples of a computer-readable medium include (but are not limited to) magnetic disk(s), memory chip(s), ROM, RAM, an ASIC, a configured processor, optical storage, or any other medium from which a computer processor can read instructions 210. The instructions 210 can include processor-specific instructions generated by a compiler or an interpreter from code written in any suitable computer-programming language, including, for example, C, C++, C#, Perl, Java, Python, etc.

In some examples, the memory 207 can be a non-transitory computer readable medium and can include computer program instructions 210. For example, the computer program instructions 210 can be executed by the processor 204 for causing the processor 204 to perform various operations. For example, the processor 204 can receive input data 211 from a downhole tool 117 in the wellbore 108 and can determine parameters 213 for the tripping operation with respect to the wellbore 108 based on the input data 211. The input data 211 can be collected and the parameters 213 can be determined for a predetermined interval 212 of the wellbore 108. The parameters 213 can be combined to determine an overall condition 214 of the tripping operation. The parameters 213 can be used to determine the overall condition 214 or a subset of the parameters 213 can be used to determine the overall condition 214. The overall condition 214 can be a measurement of the condition of the tripping operation with respect to the wellbore 108. Values of the parameters 213 can be added together or otherwise combined to generate an overall condition value. In some examples, the overall condition value can be compared to a measured overall condition value, based on measured values of the parameters 213 from theoretical data, to determine a status of the overall condition 214 of the tripping operation. The status of the overall condition 214 of the tripping operation can be related to the stability of the wellbore 108. A status can also be determined for the parameters 213 by comparing a parameter 213 to a measured parameter based on theoretical data. In some examples, the status of the parameters 213 or the overall condition 214 of the tripping operation can be optimal, sufficient, or insufficient. Additionally, the processor 204 can generate a trip map 215 that can include the parameters 213, the overall condition 214, and corresponding statuses of the parameters 213 and the overall condition 214 for the tripping operation. A new trip map or an updated trip map can be generated for every predetermined interval 212 of the wellbore 108.

The computing device 130 can additionally include an input/output 232. The input/output 232 can connect to a keyboard, a pointing device, a display, other computer input/output devices or any combination thereof. An operator or other suitable user may provide input using the input/output 232. Data relating to the wellbore 108, the tripping operation, the trip map 215, or a combination thereof can be displayed to an operator or other suitable user related to the tripping operation through a display that is connected to or is part of the input/output 232. The displayed values can be observed by the operator, a supervisor, or other suitable user related to the tripping operation, who can adjust the tripping operation based on the displayed values. Alternatively, the computing device 130 can, instead of displaying the values, automatically control or adjust the tripping operation based on the trip map 215. The computing device 130 can control the tripping operation automatically by inputting one or more tripping operation set points, control parameters, operational parameters, or additional parameters determined using the trip map to an autonomous system performing the tripping operation.

Figure 3:
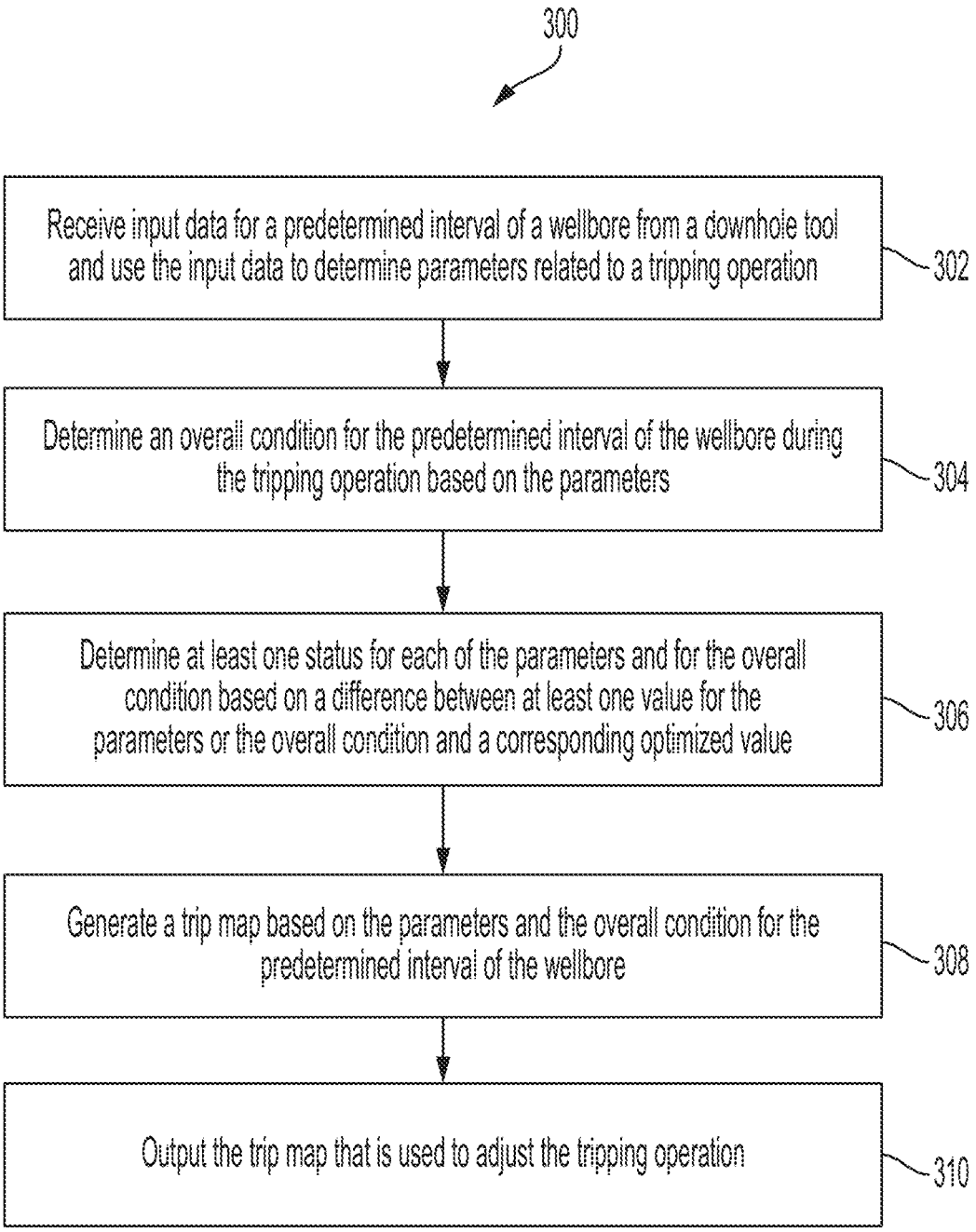
FIG. 3 is a flowchart of a process for adjusting a tripping operation in a wellbore using a trip map according to one example of the present disclosure.

FIG. 3 is a flowchart of a process 300 for adjusting a tripping operation in a wellbore 108 using a trip map 215 according to one example of the present disclosure. The tripping operation can be adjusted by an operator based on the trip map 215 or the tripping operation can be adjusted automatically based on the trip map 215. The tripping operation can involve removing or replacing a drill string 114 or other suitable components in the wellbore 108.

At block 302, computing device 130 receives input data 211 for a predetermined interval 212 of the wellbore 108 from a downhole tool 117 and uses the input data 211 to determine parameters 213 related to the tripping operation. The input data 211 can be data relating to the wellbore 108, the drill string 114, the subterranean formation 104, geothermal context in the subterranean formation 104, or any other suitable data that can affect the tripping operation. The downhole tool 117 can be a measurement-while-drilling (MWD), logging-while-drilling (LWD) tool, distributed acoustic sensor, or other suitable tool for collecting data during the tripping operation.

The computing device 130 may input the input data 211 into a micro-service, an engineering model, or the like to generate parameters 213. The micro-service can be a small independent service that serves a single function, such as returning a parameter 213 based on the input data 211. The engineering model can be a technique for analyzing, determining, validating, or a combination thereof the parameters 213 based on the input data 211. The parameters 213 of the tripping operation can change over the length of the wellbore 108, thus input data 211 can be collected for the predetermined interval 212. The predetermined interval 212 of the wellbore 108 can be chosen or adjusted by an operator or automatically by the computing device 130. Additionally, a tripping operation can be performed in intervals as a portion of the drill string 114 or another suitable component is removed or replaced in the wellbore 108. As a result, the predetermined interval 212 of the wellbore 108 may relate to a length of the portion of the drill string 114.

The parameters 213 can include tripping operation set point parameters for planning the tripping operation, control parameters for controlling the tripping operation, and wellbore parameters for monitoring the wellbore conditions during the tripping operation. Examples of the tripping operation set point parameters can include a speed of the tripping operation, a length of the portion of the drill string removed or replaced in an interval of the tripping operation, or any other suitable parameters for planning the tripping operation. Examples of the control parameters can include runnability index, equivalent circulating density, equivalent mud weight, optimum speed, static drag, or additional parameters related to controlling the tripping operation. Examples of the wellbore parameters can include inclination, pore pressure, rock strength, swab influx, swab pressure, or other suitable parameters related to monitoring wellbore conditions.

At block 304, the computing device 130 determines an overall condition 214 for the predetermined interval 212 of the wellbore 108 during the tripping operation based on the parameters 213. The overall condition 214 can be an estimation of the condition of the tripping operation with respect to the wellbore 108 and can be used to determine the stability of the wellbore 108. The overall condition 214 can be determined by adding values of the parameters 213 together or otherwise combining the parameters 213 to provide the overall condition 214. An estimated value can also be determined for the overall condition 214 based on theoretical data, historical data, or a theoretical model.

At block 306, the computing device 130 determines at least one status for each of the parameters 213 and for the overall condition 214 based on a difference between at least one value for the parameters 213 or the overall condition 214 and a corresponding optimized value. The at least one value for the parameters 213 or the overall condition 214 can be based on input data 211 and can be calculated by a microservice, engineering model, or the like. The corresponding optimized value can be based on historical data, theoretical data, a theoretical model, or other suitable techniques or data for estimating the parameters 213 or the overall condition 214. The corresponding optimized value may also be output from a microservice, engineering model, or the like and can represent the optimal value for the parameters 213 or the overall condition 214.

In some examples, the at least one status can include three statuses that can indicate the parameters 213 or overall condition 214 are optimal, sufficient, or insufficient. The status determined for a parameter value close to a corresponding estimated value can be optimal. The status determined for a parameter with a small difference between a value for the parameter and a corresponding estimated value can be sufficient. The status determined for a parameter with a large difference between a value for the parameter and a corresponding estimated value can be insufficient.

At block 308, the computing device 130 generates a trip map 215 based on the parameters 213 and the overall condition 214 for the predetermined interval 212 of the wellbore 108. The trip map 215 can be generated by computing device 130 for display on a user interface or the trip map can be generated by computing device 130 and input into an autonomous system controlling the tripping operation. The size, shape, colors, or other characteristics of the trip map can be adjusted by a user when generating the trip map 215. The trip map 215 can be a visual representation of the plurality of parameters and the overall condition. The trip map can include a background shape that can include the parameters 213 and the overall condition 214 positioned angularly around the background shape. The background shape can be two-dimensional or three-dimensional. In some examples the background shape can include a circle or a cylinder, however additional background shapes may be used for the trip map 215.

The trip map 215 may further include a polygon that can be positioned on the background shape. The polygon can include corners that correspond to the overall condition 214, the parameters 213, or a combination thereof. Additionally, the corners can be positioned on the trip map 215 at different radial positions based on the at least one status for the parameters 213 or overall condition 214. For example, the trip map 215 can include three status regions and the corners of the polygon corresponding to the parameters 213 and the overall condition 214 can be mapped in the status region corresponding to the previously determined at least one status. In some examples, the tripping operation may be adjusted to improve the parameters 213 or the overall condition 214 when the corner for a parameter is positioned in an area on the trip map indicating its status is insufficient (e.g., unsafe, suboptimal, or the like).

At block 310, the computing device 130 outputs the trip map 215 that can be used to adjust the tripping operation. The status of the overall condition 214 or the status of the parameters 213 can be used to determine an adjustment to the tripping operation. In some examples, the status of the overall condition 214 or the status of the parameters 213 for a predetermined interval 212 in the wellbore 108 can be sufficient or insufficient on the generated trip map 215. In response, the tripping operation can be slowed down, sped up, temporarily stopped, or otherwise altered to improve the overall condition 214 or the parameters 213. Additionally, the overall condition 214, the parameters 213, or a combination thereof can be optimized for the tripping operation using the trip map 215. The optimized parameters 213 or optimized overall condition 214 can be used to predict tripping operation set point parameters or control parameters in future tripping operations. The trip map 215 can be used as an input for autonomously adjusting the tripping operation or the trip map 215 can be analyzed by an operator or other user for adjusting the tripping operation.

Figure 4:
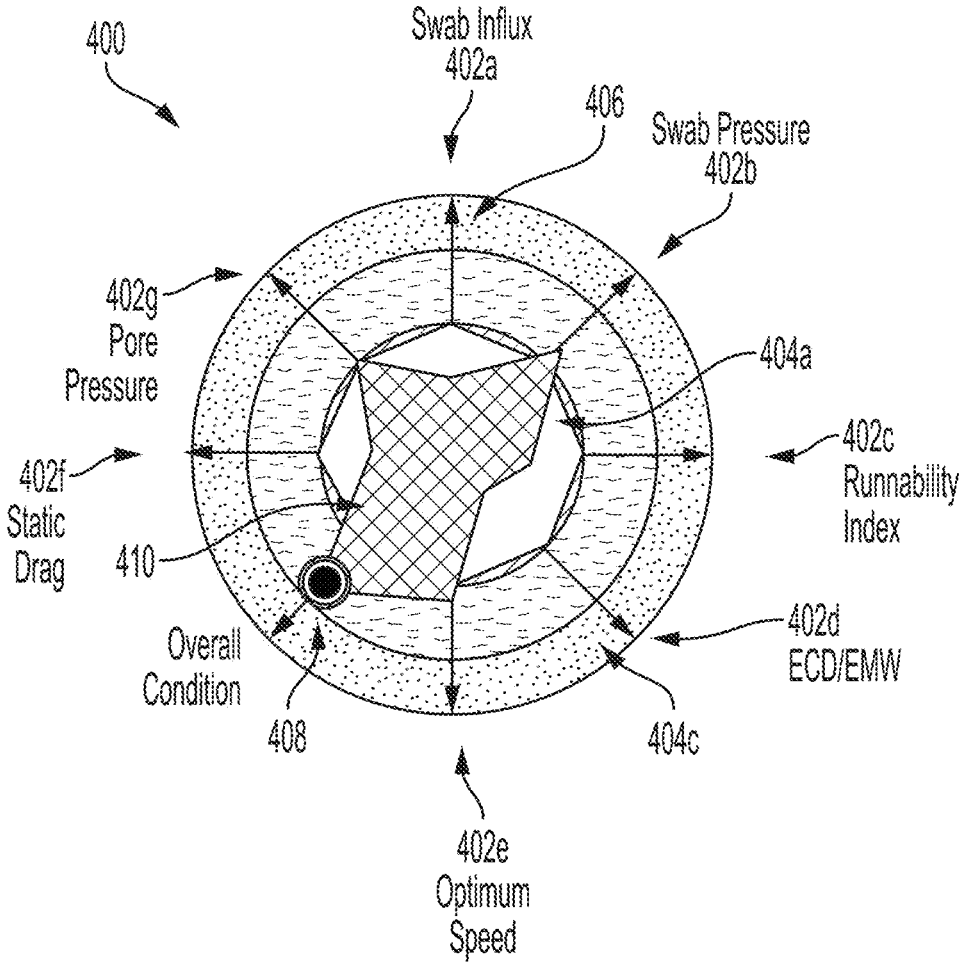
FIG. 4 is an example of a two-dimensional trip map according to one example of the present disclosure.

FIG. 4 is an example of a two-dimensional trip map 400 according to one example of the present disclosure. The two-dimensional trip map 400 can be generated for the predetermined interval 212, or any subset thereof, along the length of a wellbore 108 to continuously monitor the tripping operation and the stability of the wellbore 108. The two-dimensional trip map 400 can be generally shaped as a circle split into status regions 404*a-c*, which can indicate a status of a parameter 402*a-g* or the status of an overall condition 408 for the predetermined interval 212 of the wellbore 108. Other suitable shapes (e.g., other than a circle)

can be depicted by the two-dimensional trip map 400. An operator, crew member, or other user can adjust the colors of status regions 402*a-c*, the size of the status regions 402*a-c*, the size of the circle that includes the status regions 402*a-c*, or a combination thereof.

The two-dimensional trip map 400 can include parameters 402*a-g* that can be mapped, compared to theoretical models, and placed on a unit line 406 on the two-dimensional trip map 400. The parameters 402*a-g* can be determined in real-time during the tripping operation by collecting data from the wellbore 108 and inputting the data into micro-services. The micro-services can be services built as part of an application organized into micro-services. The micro-services can be for specific business capabilities and can perform a single function such as determining one or more of the parameters 402*a-g*. The parameters 402*a-g* can include swab influx, swab pressure, runnability index, equivalent circulating density, equivalent mud weight, optimum speed, static drag, pore pressure, additional parameters, or a combination thereof.

The two-dimensional trip map 400 can further include a polygon 410 that is created by connecting points corresponding to parameters 402*a-g*. Thus, the corners of the polygon 410 correspond to the parameters 402*a-g* and the number of sides of the polygon 410 depends on the number of parameters 402*a-g*. The placement of the corners of the polygon 410 can be determined by the values of parameters 402*a-g* with respect to their optimal values. In some examples, the value for a parameter 402*a-g* can be divided by an optimal value for the parameter. If a result of diving the parameter 402*a-g* by the optimal value is equal to or less than one, the corner of the polygon 410*a* can be in status region 404*a*, indicating the value is within an optimal value range. The status region 404*a* can include the center of the two-dimensional trip map 400. If the result is higher than one, the corner of the polygon 410 can be placed in the status region 404*b*. If the result is significantly higher than one, the corner of the polygon 410 can be in the status region 404*c*. The status region 404*b* can indicate that the parameter value is sufficient and the status region 404*c* can indicate the parameter value is insufficient. Thus, the more undesirable the values for parameters 402*a-g* are, the further out on the two-dimensional trip map 400 corresponding corners of the polygon may be placed.

Additionally, the parameters 402*a-g* can be combined to determine an overall condition 408 of the tripping operation. The overall condition 408 can be placed on the two-dimensional trip map 400 in a status region 404*a-c*. As illustrated, the overall condition 408 in the two-dimensional trip map 400 is in the sufficient region. In some examples, the corner of the polygon 410 corresponding to the overall condition 408, can be determined by adding the parameter values together and dividing by an estimated value for the overall condition 408. The estimated value for the overall condition 408 can be based on theoretical data for the parameters 402*a-g*.

The trip map, including the shape of the polygon 410, the status regions 404*a-c*, parameters 402*a-g* pointed to by unit lines 406, and the overall condition 408, can be used for quick decision-making during the tripping operation. As illustrated, swab pressure 402*b*, optimum speed 402*e*, and overall condition 408 are in the status region 404*b*, indicating that the corresponding values are above the optimal values and outside of the optimal value range. The tripping operation can be adjusted based on swab pressure 402*b* and optimum speed 402*e* to improve the overall condition 408. For example, the speed of the tripping operation may be decreased to bring the optimum speed 402*e* and the swab pressure 402*b* to the optimal region 402*a*. The two-dimensional trip map 400 for the next predetermined interval 212 of the tripping operation can indicate if the speed was decreased enough, not enough, or too much and a subsequent adjustment can be made. The two-dimensional trip map 400 can be used as input for adjusting the tripping operation autonomously or an operator can determine the adjustment by viewing the two-dimensional trip map 400 on a user interface.

Figure 5:
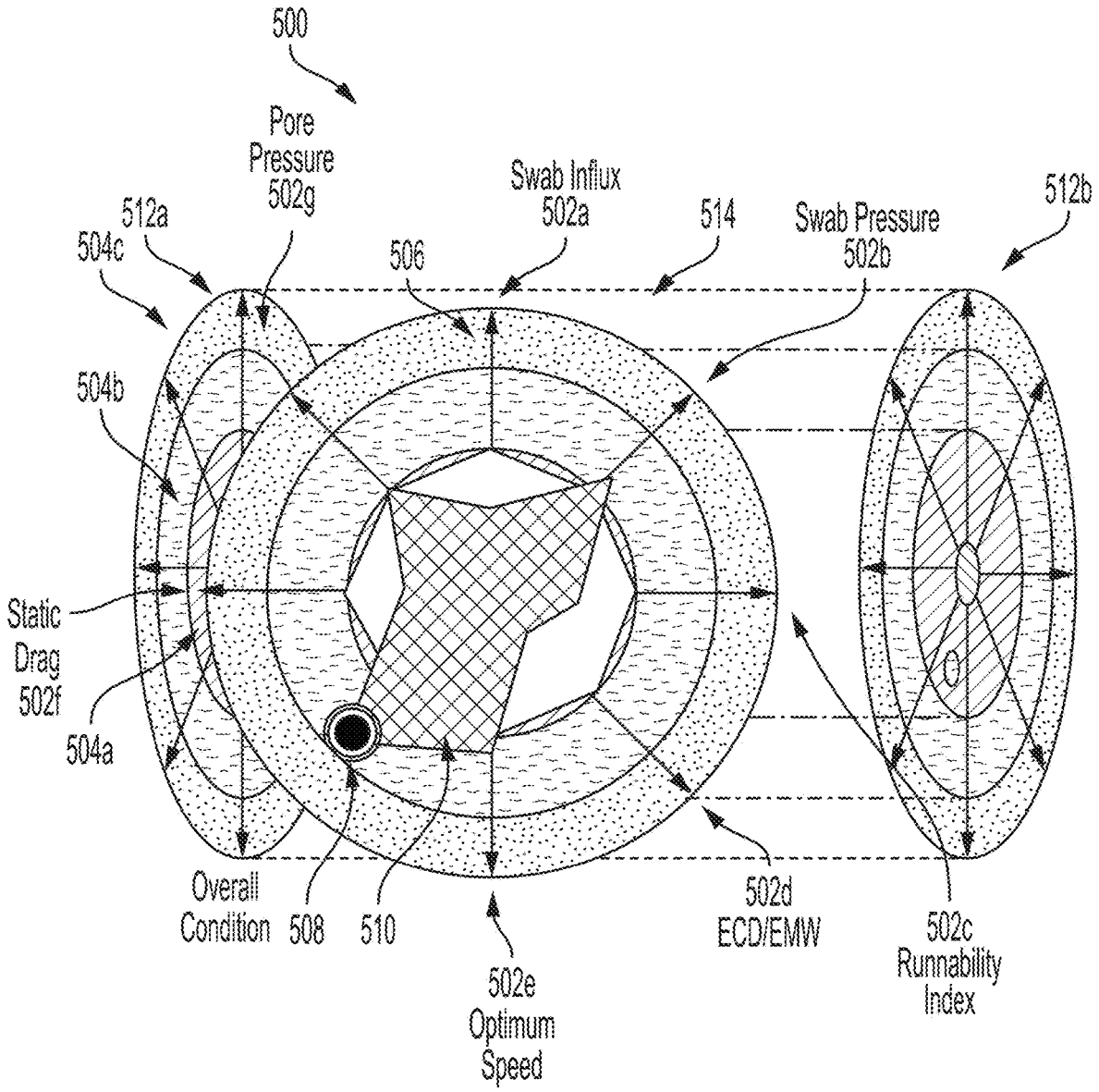
FIG. 5 is an example of a three-dimensional trip map according to one example of the present disclosure.

FIG. 5 is an example of a three-dimensional trip map 500 according to one example of the present disclosure. The three-dimensional trip map 500 can be a cylinder or any other suitable, three-dimensional shape and can be generated for each predetermined interval 212, or any subset thereof, along the length of a wellbore 108 to monitor the parameters 502*a-g* and overall condition 508. The cylindrical shape of the three-dimensional trip map 500 can be a scaled version of the predetermined interval 212 of the wellbore 108. An operator of the tripping operation or another user can adjust characteristics of the three-dimensional trip map 500. For example, the colors of status regions 502*a-c*, the size of the status regions 502*a-c*, or the dimensions of the three-dimensional trip map 500 (e.g., the diameter of ends 512*a* and 512*c* or the length of the cylinder) can be altered.

The predetermined interval 212 can be chosen such that parameters 502*a-g* and the overall condition 508 can be considered constant over the predetermined interval 212. The parameters 502*a-g* that can be mapped and compared to theoretical models and placed on a unit line 506 on the three-dimensional trip map 500. The parameters 502*a-g* can be determined in-real time during the tripping operation by collecting data from the wellbore 108 via a downhole tool 117 and inputting the data into engineering models or micro-services. The parameters 502*a-g* can include swab influx, swab pressure, runnability index, equivalent circulating density, equivalent mud weight, optimum speed, static drag, or pore pressure.

The three-dimensional trip map 500 can also include ends 512*a* and 512*c*. As illustrated, circle 514 shows the outer part of ends 512*a* and 512*b*, while ends 512*a* and 512*b* show the inner part of the three-dimensional trip map 500. The three-dimensional trip map 500 can be split into status regions 504*a-c*. The status region 504*a* can be a small cylindrical region in the center of the three-dimensional trip map 500 and can represent the optimal area for parameters 502*a-g*. The status regions 504*b* and 504*c* can be tubular regions that make up the remainder of the three-dimensional trip map 500 and can represent sufficient and insufficient areas respectively for parameters 502*a-g*.

The three-dimensional trip map 500 can further include a polygon 510. The polygon 510 can be generated by connecting points corresponding to parameters 502*a-g*. The corners of the polygon 510 can be measurements of the parameters 502*a-g* with respect to their optimal values. In some examples, the values for parameters 502*a-g* outputted by the micro-service can be divided by optimal values. If the result is equal to or less than one, the point corresponding to the parameter can be in status region 504*a*. If the result is higher than one, the corner of the polygon 510 can be placed in status regions 504*b* or 504*c*. A parameter 502*a-g* or overall condition 508 in status region 504*c* may indicate that the wellbore 108 is unstable.

Additionally, the parameters 502*a-g* can be combined to determine the overall condition 508 of the tripping operation. In some examples, the overall condition 508 can be determined by adding the parameter values together and dividing by an estimated value for the overall condition 508. If the result is equal to or less than one, the overall condition 508 can be in status region 504*a*, otherwise the overall condition 508 can be in status region 504*b* or status region 504*c*. The estimated value for the overall condition 508 can be based on theoretical data. As illustrated, the overall condition 508 in the three-dimensional trip map 500 is in the status region 504*b*, suggesting that the overall condition 508 for the current predetermined interval 212 of the wellbore 108 is not optimized.

As illustrated, the swab pressure 502*b* and the optimum speed 502*e* are in the status region 404*b*, indicating that both values are outside the optimal value range. The swab pressure 502*b* and the optimum speed 502*e* can be the reason the overall condition 508 is not optimized. The tripping operation can be adjusted based on the swab pressure 502*b* and the optimum speed 502*e* to optimize the overall condition 508. For example, the speed of the tripping operation may be decreased to decrease the optimum speed 502*e* and swab pressure 502*b*. The three-dimensional trip map 500 for the subsequent predetermined interval 212 of the tripping operation can depict if the speed was decreased enough, not enough, or too much and a subsequent adjustment can be made. The three-dimensional trip map 500 can be used as input for adjusting the tripping operation autonomously or an operator can determine the adjustment by viewing the three-dimensional trip map 500 on a user interface.

Figure 6:
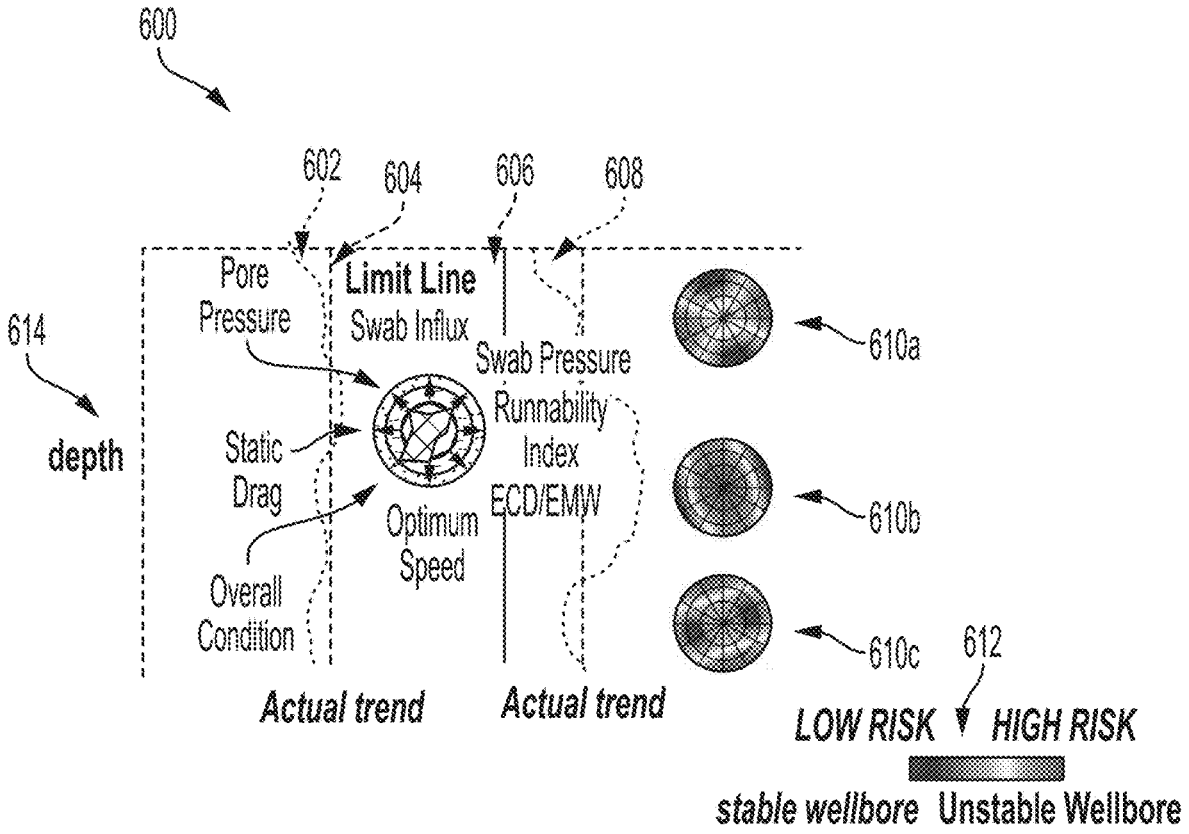
FIG. 6 is an example of an overall condition plot according to one example of the present disclosure.

FIG. 6 is an example of an overall condition plot 600 according to one example of the present disclosure. The overall condition plot 600 can include a first trendline 602 representing one or more overall conditions and a limit line 604. The one or more overall conditions can be plotted at a depth 614 corresponding to the one or more predetermined intervals 212 of a wellbore 108. Thus, the first trendline 602 can show the general course of the overall conditions of the tripping operation over the corresponding predetermined intervals 212 along the length of the wellbore 108. The limit line 604 can be determined using one or more calculated limiting values. The calculated limiting values can include torsional instability, lateral instability, ROP coupled bit wear, hole cleaning, mechanical specific energy, hydro mechanical specific energy, motor stall weight, or motor stall speed. The optimal overall condition of the tripping operation for a stable wellbore can be bounded by the limiting values. The areas of the overall condition plot 600 where an overall condition line (e.g., the first trendline 602) crosses over the limit line 604 can include an intuitive visual representation of the stability of the wellbore 108.

The overall condition plot 600 can be overlaid with additional information to provide a comprehensive view of the tripping operation. In some examples, a trip map 606 for an overall condition can be overlaid on the overall condition plot 600. As illustrated, the trip map 606 for a portion of the first trendline 602 that crosses the limit line 604 is overlaid on the overall condition plot 600. The depth 614 corresponding to the portion of the first trendline 602 can be used to locate an unstable region of the wellbore 108. The trip map 606 can provide information on the parameters that relate to the unstable region of the wellbore 108.

Additionally, the overall condition plot 600 can include a second trendline 608 that represents lithology conditions at corresponding depths 614 in the wellbore 108 and geo-mechanical maps 610*a-c*. The second trendline 608 and the geo-mechanical maps 610*a-c* can provide information on the subterranean formation 104 and can be used to find correlations between the stability of the wellbore 108 during the tripping operation and characteristics of the subterranean formation 104. The geo-mechanical maps 610*a-c* can include a legend 612 to clarify which areas of the geo-mechanical maps 610*a-c* represent stable wellbore conditions and which areas represent unstable wellbore conditions. The geo-mechanical maps 610*a-c* can also be placed on the overall condition plot 600 at the depth 614 in the wellbore 108 the geo-mechanical map 610*a-c* depicts.

In some examples, the overall condition plot 600 can be used to quickly determine an adjustment to the tripping operation. The overall condition plot 600 can be displayed on a user interface for an operator of the tripping operation, or the overall condition plot 600 can be used as input to autonomously control the tripping operation. Additionally, the overall condition plot 600 can be used to analyze tripping operation conditions, wellbore conditions, wellbore stability, or a combination thereof after the tripping operation to improve subsequent tripping operations.

Figure 7:
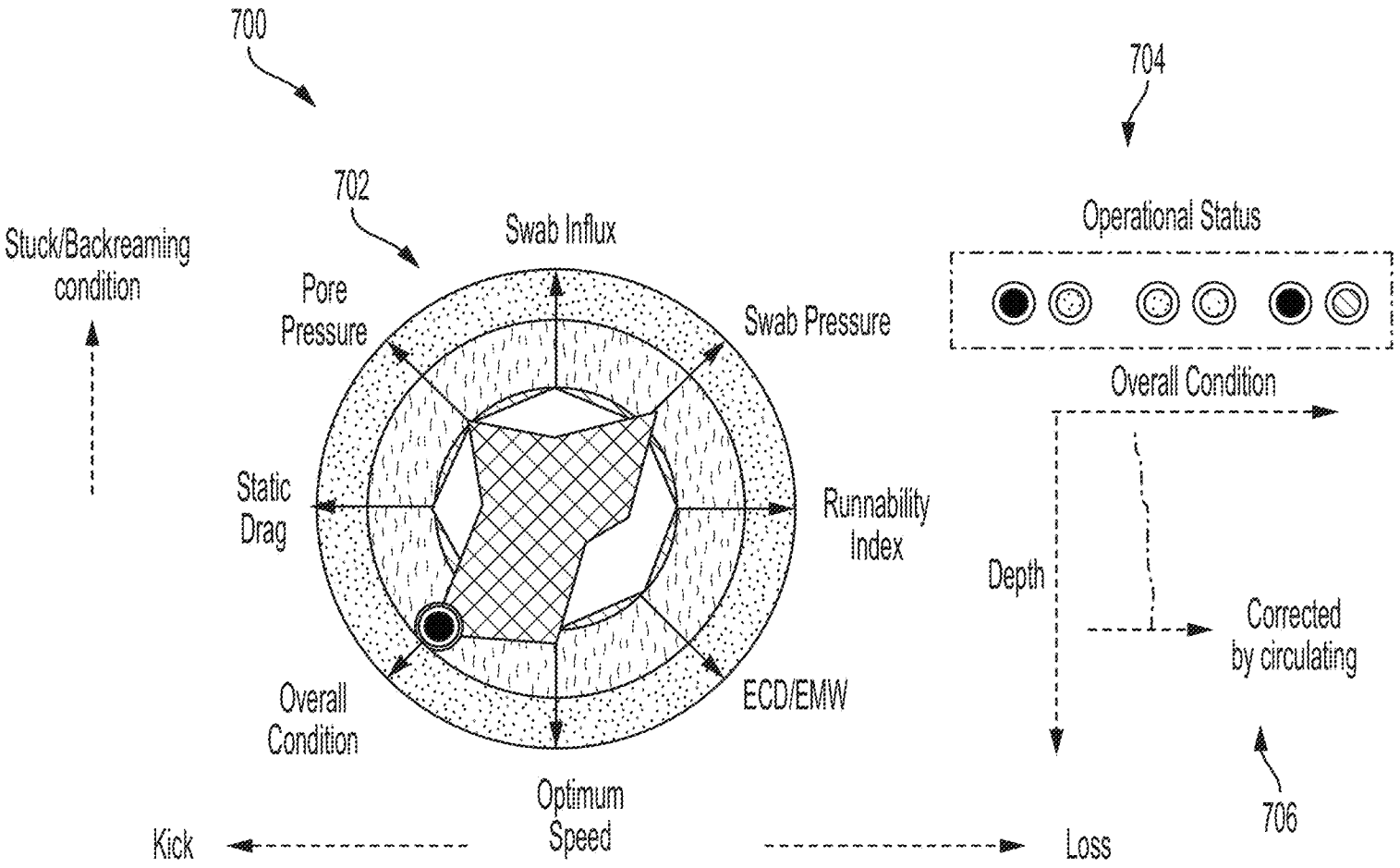
FIG. 7 is an example of a user interface according to one example of the present disclosure.

FIG. 7 is an example of a user interface 700 for providing the trip map and other suitable features according to one example of the present disclosure. As illustrated, the user interface 700 includes a two-dimensional trip map 702, an operational status legend 704, and an overall condition plot 706, however the user interface 700 may include other suitable plots or sections related to the tripping operation. The two-dimensional trip map 702 may include parameters and an overall condition. The two-dimensional trip map 702 can further include kick, loss, and back-reaming conditions. The overall condition plot 706 may include the overall conditions for one or more intervals of a wellbore 108 plotted at corresponding depths. As illustrated, a trendline can be created on overall condition plot 706 by connecting overall conditions for predetermined intervals along the length of the wellbore 108.

The computing device 130 may generate and output the trip map 702 for providing via the user interface 700. In some examples, a new trip map can be generated and displayed on the user interface 700 for the predetermined interval 212 of the wellbore 108. Additionally, the overall condition plot 706 can be updated with the overall condition from the new trip map. In some examples, the user interface 700 may display the trip map 702 from a predetermined interval 212 of the wellbore 108 the drill string 114 has not entered to check the stability of the wellbore 108 prior to performing the tripping operation. In other examples, the trip map 702 can show a predetermined interval of the wellbore 108 during the tripping operation to check the stability of the wellbore 108 during or after the tripping operation. Moreover, the tripping operation can be adjusted or controlled autonomously based on two-dimensional the trip map 702, the overall condition plot 706, other suitable displays, or a combination thereof on user interface 700.

In some aspects, systems, methods, and non-transitory computer-readable mediums for a trip map for adjusting a tripping operation in a wellbore are provided according to one or more of the following examples:

As used below, any reference to a series of examples is to be understood as a reference to each of those examples disjunctively (e.g., "Examples 1-4" is to be understood as "Examples 1, 2, 3, or 4").

Example 1 is a system comprising: a processor; and a non-transitory computer-readable medium that includes instructions executable by the processor for causing the processor to perform operations comprising: receiving input data for a predetermined interval of a wellbore from a downhole tool deployable in the wellbore, the input data usable to determine a plurality of parameters relating to a tripping operation with respect to the wellbore; determining an overall condition for the predetermined interval of the wellbore during the tripping operation based on the plurality of parameters; determining at least one status for each parameter of the plurality of parameters and for the overall condition based on a difference between at least one value for the plurality of parameters or the overall condition and a corresponding optimized value; generating a trip map based on the plurality of parameters and the overall condition for the predetermined interval of the wellbore, the trip map being a visual representation of the plurality of parameters and the overall condition, the trip map comprising: a background shape including the plurality of parameters and the overall condition positioned angularly around the background shape; a polygon positioned on the background shape, the polygon including a plurality of corners, each corner of the plurality of corners corresponding to the overall condition or to different parameters of the plurality of parameters, each corner positioned at different radial positions of the background shape based on the at least one status; and outputting, by a user interface, the trip map that is usable to adjust the tripping operation.

Example 2 is the system of example 1, wherein the plurality of parameters includes tripping operation set point parameters for planning the tripping operation, control parameters for controlling the tripping operation, and wellbore parameters for monitoring wellbore conditions during the tripping operation.

Example 3 is the system of example 1, wherein the operation of outputting the trip map further comprises: generating visual indicators for the plurality of parameters in the trip map, the visual indicators connecting the plurality of corners of the polygon to the plurality of parameters; determining optimized values for the plurality of parameters based on theoretical data; determining measured values for the plurality of parameters based on the input data; determining the at least one status of the plurality of parameters based on differences between the optimized values and the measured values; generating at least one circular region on the trip map corresponding to the at least one status of the plurality of parameters; and providing, via the user interface, the trip map with the polygon and the visual indicators for the plurality of parameters in the at least one circular region for adjusting the tripping operation.

Example 4 is the system of example 1, further comprising outputting an overall condition plot by: determining the overall condition for the predetermined interval by combining values of the plurality of parameters to generate a value for the overall condition; plotting the overall condition at a depth corresponding to the predetermined interval; generating a trendline by connecting a plurality of overall conditions with the trendline over a certain depth; and providing, via the user interface, the trendline.

Example 5 is the system of example 1, wherein the operation of determining the overall condition comprises: determining an optimized value for the overall condition based on theoretical data; determining a measured value for the overall condition based on the plurality of parameters; and comparing the optimized value of the overall condition to the measured value of the overall condition.

Example 6 is the system of example 1, further comprising the operation of adjusting the tripping operation by adjusting at least one aspect of the tripping operation, the at least one aspect including a speed of the tripping operation, a direction of the tripping operation, or stopping or resuming the tripping operation.

Example 7 is the system of example 1, wherein the plurality of parameters includes swab influx, swab pressure, runnability index, equivalent circulating density, equivalent mud weight, optimum speed, static drag, and pore pressure.

Example 8 is the system of example 1, further comprising adjusting the tripping operation autonomously by: receiving the trip map or an overall condition plot; determining an adjustment to the tripping operation based on the trip map or the overall condition plot; and adjusting the tripping operation based on the adjustment.

Example 9 is the system of example 1, wherein the trip map is a three-dimensional trip map, wherein the three-dimensional trip map is a cylindrical visual representation of the plurality of parameters and the overall condition, and wherein the three-dimensional trip map includes a length of the predetermined interval.

Example 10 is a method comprising: receiving, by a processing device, input data for a predetermined interval of a wellbore from a downhole tool deployable in the wellbore, the input data usable to determine a plurality of parameters relating to a tripping operation with respect to the wellbore; determining, by the processing device, an overall condition for the predetermined interval of the wellbore during the tripping operation based on the plurality of parameters; determining, by the processing device, at least one status for each parameter of the plurality of parameters and for the overall condition based on a difference between at least one value for the plurality of parameters or the overall condition and a corresponding optimized value; generating, by the processing device, a trip map based on the plurality of parameters and the overall condition for the predetermined interval of the wellbore, the trip map being a visual representation of the plurality of parameters and the overall condition, the trip map comprising: a background shape including the plurality of parameters and the overall condition positioned angularly around the background shape; a polygon positioned on the background shape, the polygon including a plurality of corners, each corner of the plurality of corners corresponding to the overall condition or to different parameters of the plurality of parameters, each corner positioned at different radial positions of the background shape based on the at least one status; and outputting, by a user interface, the trip map that is usable to adjust the tripping operation.

Example 11 is the method of example 10, wherein the plurality of parameters includes tripping operational set point parameters for planning the tripping operation, control parameters for controlling the tripping operation, and wellbore parameters for monitoring wellbore conditions during the tripping operation.

Example 12 is the method of example 10, wherein outputting the trip map further comprises: generating, by the processing device, visual indicators for the plurality of parameters in the trip map, the visual indicators connecting the plurality of corners of the polygon to the plurality of parameters; determining, by the processing device, optimized values for the plurality of parameters based on theoretical data; determining, by the processing device, measured values for the plurality of parameters based on the input data; determining, by the processing device, the at least one status of the plurality of parameters based on differences between the optimized values and the measured values; generating, by the processing device, at least one circular region on the trip map corresponding to the at least one status of the plurality of parameters; and providing, via the user interface, the trip map with the polygon and the visual indicators for the plurality of parameters in the at least one circular region for adjusting the tripping operation.

Example 13 is the method of example 10, further comprising outputting an overall condition plot by: determining, by the processing device, the overall condition for the predetermined interval by combining values of the plurality of parameters to generate a value for the overall condition; plotting, by the processing device, the overall condition at a depth corresponding to the predetermined interval; generating, by the processing device, a trendline by connecting a plurality of overall conditions with the trendline over a certain depth; and providing, via the user interface, the trendline.

Example 14 is the method of example 10, wherein determining the overall condition comprises: determining, by the processing device, an optimized value for the overall condition based on theoretical data; determining, by the processing device, a measured value for the overall condition based on the plurality of parameters; and comparing, by the processing device, the optimized value of the overall condition to the measured value of the overall condition.

Example 15 is the method of example 10, further comprising adjusting the tripping operation by adjusting, by the processing device, at least one aspect of the tripping operation, the at least one aspect including a speed of the tripping operation, a direction of the tripping operation, or stopping or resuming the tripping operation.

Example 16 is a non-transitory computer-readable medium comprising instructions that are executable by a processing device for causing the processing device to perform operations comprising: receiving input data for a predetermined interval of a wellbore from a downhole tool deployable in the wellbore, the input data usable to determine a plurality of parameters relating to a tripping operation with respect to the wellbore; determining an overall condition for the predetermined interval of the wellbore during the tripping operation based on the plurality of parameters; determining at least one status for each parameter of the plurality of parameters and for the overall condition based on a difference between at least one value for the plurality of parameters or the overall condition and a corresponding optimized value; generating a trip map based on the plurality of parameters and the overall condition for the predetermined interval of the wellbore, the trip map being a visual representation of the plurality of parameters and the overall condition, the trip map comprising: a background shape including the plurality of parameters and the overall condition positioned angularly around the background shape; a polygon positioned on the background shape, the polygon including a plurality of corners, each corner of the plurality of corners corresponding to the overall condition or to different parameters of the plurality of parameters, each corner positioned at different radial positions of the background shape based on the at least one status; and outputting, by a user interface, the trip map that is usable to adjust the tripping operation.

Example 17 is the non-transitory computer-readable medium of example 16, further comprising the operation of adjusting the tripping operation by adjusting at least one aspect of the tripping operation, the at least one aspect including a speed of the tripping operation, a direction of the tripping operation, or stopping or resuming the tripping operation.

Example 18 is the non-transitory computer-readable medium of example 16, wherein the plurality of parameters includes swab influx, swab pressure, runnability index, equivalent circulating density, equivalent mud weight, optimum speed, static drag, and pore pressure.

Example 19 is the non-transitory computer-readable medium of example 16, further comprising adjusting the tripping operation autonomously by: receiving the trip map or an overall condition plot; determining an adjustment to the tripping operation based on the trip map or the overall condition plot; and adjusting the tripping operation based on the adjustment.

Example 20 is the non-transitory computer-readable medium of example 16, wherein the trip map is a three-dimensional trip map, wherein the three-dimensional trip map is a cylindrical visual representation of the plurality of parameters and the overall condition, and wherein the three-dimensional trip map includes a length of the predetermined interval.

The foregoing description of certain examples, including illustrated examples, has been presented only for the purpose of illustration and description and is not intended to be exhaustive or to limit the disclosure to the precise forms disclosed. Numerous modifications, adaptations, and uses thereof will be apparent to those skilled in the art without departing from the scope of the disclosure.

What is claimed is:

1. A system comprising:

a processor; and a non-transitory computer-readable medium that includes instructions executable by the processor for causing the processor to perform operations comprising:

receiving input data for a predetermined interval of a wellbore from a downhole tool deployable in the wellbore, the input data usable to determine a plurality of parameters relating to a tripping operation with respect to the wellbore;

determining an overall condition for the predetermined interval of the wellbore during the tripping operation based on the plurality of parameters;

determining at least one status for each parameter of the plurality of parameters and for the overall condition based on a difference between at least one value for the plurality of parameters or the overall condition and a corresponding optimized value;

generating a trip map based on the plurality of parameters and the overall condition for the predetermined interval of the wellbore, the trip map being a visual representation of the plurality of parameters and the overall condition, the trip map comprising:

a background shape including the plurality of parameters and the overall condition positioned angularly around the background shape;

a polygon positioned on the background shape, the polygon including a plurality of corners, each corner of the plurality of corners corresponding to the overall condition or to different parameters of the plurality of parameters, each corner positioned at different radial positions of the background shape based on the at least one status; and outputting, by a user interface, the trip map that is usable to adjust the tripping operation.

2. The system of claim 1, wherein the plurality of parameters includes tripping operation set point parameters for planning the tripping operation, control parameters for controlling the tripping operation, and wellbore parameters for monitoring wellbore conditions during the tripping operation.

3. The system of claim 1, wherein the operation of outputting the trip map further comprises:

generating visual indicators for the plurality of parameters in the trip map, the visual indicators connecting the plurality of corners of the polygon to the plurality of parameters;

determining optimized values for the plurality of parameters based on theoretical data;

determining measured values for the plurality of parameters based on the input data;

determining the at least one status of the plurality of parameters based on differences between the optimized values and the measured values;

generating at least one circular region on the trip map corresponding to the at least one status of the plurality of parameters; and providing, via the user interface, the trip map with the polygon and the visual indicators for the plurality of parameters in the at least one circular region for adjusting the tripping operation.

4. The system of claim 1, further comprising outputting an overall condition plot by:

determining the overall condition for the predetermined interval by combining values of the plurality of parameters to generate a value for the overall condition;

plotting the overall condition at a depth corresponding to the predetermined interval;

generating a trendline by connecting a plurality of overall conditions with the trendline over a certain depth; and providing, via the user interface, the trendline.

5. The system of claim 1, wherein the operation of determining the overall condition comprises:

determining an optimized value for the overall condition based on theoretical data;

determining a measured value for the overall condition based on the plurality of parameters; and comparing the optimized value of the overall condition to the measured value of the overall condition.

6. The system of claim 1, further comprising the operation of adjusting the tripping operation by adjusting at least one aspect of the tripping operation, the at least one aspect including a speed of the tripping operation, a direction of the tripping operation, or stopping or resuming the tripping operation.

7. The system of claim 1, wherein the plurality of parameters includes swab influx, swab pressure, runnability index, equivalent circulating density, equivalent mud weight, optimum speed, static drag, and pore pressure.

8. The system of claim 1, further comprising adjusting the tripping operation autonomously by:

receiving the trip map or an overall condition plot;

determining an adjustment to the tripping operation based on the trip map or the overall condition plot; and adjusting the tripping operation based on the adjustment.

9. The system of claim 1, wherein the trip map is a three-dimensional trip map, wherein the three-dimensional trip map is a cylindrical visual representation of the plurality of parameters and the overall condition, and wherein the three-dimensional trip map includes a length of the predetermined interval.

10. A method comprising:

receiving, by a processing device, input data for a predetermined interval of a wellbore from a downhole tool deployable in the wellbore, the input data usable to determine a plurality of parameters relating to a tripping operation with respect to the wellbore;

determining, by the processing device, an overall condition for the predetermined interval of the wellbore during the tripping operation based on the plurality of parameters;

determining, by the processing device, at least one status for each parameter of the plurality of parameters and for the overall condition based on a difference between at least one value for the plurality of parameters or the overall condition and a corresponding optimized value;

generating, by the processing device, a trip map based on the plurality of parameters and the overall condition for the predetermined interval of the wellbore, the trip map being a visual representation of the plurality of parameters and the overall condition, the trip map comprising:

a background shape including the plurality of parameters and the overall condition positioned angularly around the background shape;

a polygon positioned on the background shape, the polygon including a plurality of corners, each corner of the plurality of corners corresponding to the overall condition or to different parameters of the plurality of parameters, each corner positioned at different radial positions of the background shape based on the at least one status; and outputting, by a user interface, the trip map that is usable to adjust the tripping operation.

11. The method of claim 10, wherein the plurality of parameters includes tripping operational set point parameters for planning the tripping operation, control parameters for controlling the tripping operation, and wellbore parameters for monitoring wellbore conditions during the tripping operation.

12. The method of claim 10, wherein outputting the trip map further comprises:

generating, by the processing device, visual indicators for the plurality of parameters in the trip map, the visual indicators connecting the plurality of corners of the polygon to the plurality of parameters;

determining, by the processing device, optimized values for the plurality of parameters based on theoretical data;

determining, by the processing device, measured values for the plurality of parameters based on the input data;

determining, by the processing device, the at least one status of the plurality of parameters based on differences between the optimized values and the measured values;

generating, by the processing device, at least one circular region on the trip map corresponding to the at least one status of the plurality of parameters; and providing, via the user interface, the trip map with the polygon and the visual indicators for the plurality of parameters in the at least one circular region for adjusting the tripping operation.

13. The method of claim 10, further comprising outputting an overall condition plot by:

determining, by the processing device, the overall condition for the predetermined interval by combining values of the plurality of parameters to generate a value for the overall condition;

plotting, by the processing device, the overall condition at a depth corresponding to the predetermined interval;

generating, by the processing device, a trendline by connecting a plurality of overall conditions with the trendline over a certain depth; and providing, via the user interface, the trendline.

14. The method of claim 10, wherein determining the overall condition comprises:

determining, by the processing device, an optimized value for the overall condition based on theoretical data;

determining, by the processing device, a measured value for the overall condition based on the plurality of parameters; and comparing, by the processing device, the optimized value of the overall condition to the measured value of the overall condition.

15. The method of claim 10, further comprising adjusting the tripping operation by adjusting, by the processing device, at least one aspect of the tripping operation, the at least one aspect including a speed of the tripping operation, a direction of the tripping operation, or stopping or resuming the tripping operation.

16. A non-transitory computer-readable medium comprising instructions that are executable by a processing device for causing the processing device to perform operations comprising:

receiving input data for a predetermined interval of a wellbore from a downhole tool deployable in the wellbore, the input data usable to determine a plurality of parameters relating to a tripping operation with respect to the wellbore;

determining an overall condition for the predetermined interval of the wellbore during the tripping operation based on the plurality of parameters;

determining at least one status for each parameter of the plurality of parameters and for the overall condition based on a difference between at least one value for the plurality of parameters or the overall condition and a corresponding optimized value;

generating a trip map based on the plurality of parameters and the overall condition for the predetermined interval of the wellbore, the trip map being a visual representation of the plurality of parameters and the overall condition, the trip map comprising:

a background shape including the plurality of parameters and the overall condition positioned angularly around the background shape;

a polygon positioned on the background shape, the polygon including a plurality of corners, each corner of the plurality of corners corresponding to the overall condition or to different parameters of the plurality of parameters, each corner positioned at different radial positions of the background shape based on the at least one status; and outputting, by a user interface, the trip map that is usable to adjust the tripping operation.

17. The non-transitory computer-readable medium of claim 16, further comprising the operation of adjusting the tripping operation by adjusting at least one aspect of the tripping operation, the at least one aspect including a speed of the tripping operation, a direction of the tripping operation, or stopping or resuming the tripping operation.

18. The non-transitory computer-readable medium of claim 16, wherein the plurality of parameters includes swab influx, swab pressure, runnability index, equivalent circulating density, equivalent mud weight, optimum speed, static drag, and pore pressure.

19. The non-transitory computer-readable medium of claim 16, further comprising adjusting the tripping operation autonomously by:

receiving the trip map or an overall condition plot;

determining an adjustment to the tripping operation based on the trip map or the overall condition plot; and adjusting the tripping operation based on the adjustment.

20. The non-transitory computer-readable medium of claim 16, wherein the trip map is a three-dimensional trip map, wherein the three-dimensional trip map is a cylindrical visual representation of the plurality of parameters and the overall condition, and wherein the three-dimensional trip map includes a length of the predetermined interval.

* * * * *